US007341647B2

(12) United States Patent
Yamasaki

(10) Patent No.: US 7,341,647 B2
(45) Date of Patent: Mar. 11, 2008

(54) COKE CARBONIZATION FURNACE COVER FOR PROMOTING INCREASE IN TEMPERATURE OF COAL PARTICLES NEAR THE COVER

(75) Inventor: Kesao Yamasaki, Kitakyushu (JP)

(73) Assignee: Yamasaki Industries Co., Ltd., Fukuoka (JP)

( * ) Notice: Subject to any disclaimer, the term of this patent is extended or adjusted under 35 U.S.C. 154(b) by 165 days.

(21) Appl. No.: 10/519,509

(22) PCT Filed: Jun. 12, 2003

(86) PCT No.: PCT/JP03/07480

§ 371 (c)(1),
(2), (4) Date: Sep. 6, 2005

(87) PCT Pub. No.: WO2004/007639

PCT Pub. Date: Jan. 22, 2004

(65) Prior Publication Data

US 2006/0231380 A1 Oct. 19, 2006

(30) Foreign Application Priority Data

| | | |
|---|---|---|
| Jun. 13, 2002 | (JP) | 2002-210272 |
| Jun. 18, 2002 | (JP) | 2002-214562 |
| Jun. 26, 2002 | (JP) | 2002-224184 |
| Jul. 16, 2002 | (JP) | 2002-239911 |
| Aug. 9, 2002 | (JP) | 2002-267396 |
| Aug. 29, 2002 | (JP) | 2002-294244 |
| Sep. 12, 2002 | (JP) | 2002-307672 |
| Oct. 29, 2002 | (JP) | 2002-353107 |

(51) Int. Cl.
*C10B 25/00* (2006.01)
*C10B 25/24* (2006.01)

(52) U.S. Cl. ..... 202/242; 202/248; 202/269; 202/270

(58) Field of Classification Search ..... 202/242, 202/247, 248, 268
See application file for complete search history.

(56) References Cited

U.S. PATENT DOCUMENTS

| | | | | |
|---|---|---|---|---|
| 4,381,972 | A * | 5/1983 | Stog | 202/248 |
| 4,414,072 | A | 11/1983 | Breidenbach et al. | |
| 4,552,623 | A * | 11/1985 | Urbye et al. | 202/248 |
| 4,647,342 | A | 3/1987 | Stog et al. | |

(Continued)

FOREIGN PATENT DOCUMENTS

| | | |
|---|---|---|
| JP | 54-134701 | 10/1979 |

(Continued)

*Primary Examiner*—N. Bhat
(74) *Attorney, Agent, or Firm*—Jordan and Hamburg LLP

(57) ABSTRACT

A coke oven door prevents the generation of poor-quality-coke and yielding and adhesion of tar by promoting the temperature rise of coal particles charged near the coke oven door of a coke oven. The coke oven door comprises a heat-insulating box provided on the coke oven side of a oven door structure adapted to open and close an opening in the coke oven in which the coal particles are charged, horizontal support frames fitted in said heat-insulating box to vertically partition the heat-insulating box into multiple sections, and a bottom-less gas migration and isolation hollow plug formed by laterally and vertically putting together removable shield bars in spaces between said horizontal support frames with small ventilating spaces left on both sides thereof.

10 Claims, 14 Drawing Sheets

U.S. PATENT DOCUMENTS

| | | | | |
|---|---|---|---|---|
| 4,917,772 | A * | 4/1990 | Koschlig et al. | 202/242 |
| 5,312,935 | A | 5/1994 | Mayer et al. | |
| 5,603,810 | A * | 2/1997 | Michler | 202/248 |
| 5,720,855 | A * | 2/1998 | Baird | 202/248 |
| 6,139,692 | A * | 10/2000 | Tamura et al. | 201/41 |
| 7,067,043 | B1 * | 6/2006 | Giertz et al. | 202/239 |

FOREIGN PATENT DOCUMENTS

| | | |
|---|---|---|
| JP | 60-25072 | 6/1985 |
| JP | 61-49353 | 10/1986 |
| JP | 62-072782 | 4/1987 |
| JP | 63-112686 | 5/1988 |
| JP | 2-69946 | 5/1990 |
| JP | 2-26913 | 7/1990 |
| JP | 3-40074 | 6/1991 |
| JP | 5-38795 | 6/1993 |
| JP | 5-56940 | 7/1993 |
| JP | 6-212159 | 8/1994 |
| JP | 6-264061 | 9/1994 |
| JP | 6-43146 | 11/1994 |
| JP | 7-118644 | 5/1995 |
| JP | 7-126649 | 5/1995 |
| JP | 2001-288472 | 10/2001 |

* cited by examiner

COKE CARBONIZATION FURNACE COVER FOR PROMOTING INCREASE IN TEMPERATURE OF COAL PARTICLES NEAR THE COVER

FIELD OF THE INVENTION

This invention relates to doors of coke ovens for manufacturing coke by coking coal particles charged into coke oven chambers (furnaces) by the high-temperature heat supplied from combustion chambers (furnaces) adjacent thereto, and particularly to coke oven doors for reducing the generation of poor-quality coke by promoting the temperature increase of the coal particles charged near the coke oven door plugs.

BACKGROUND OF THE INVENTION

A coke oven battery for producing coke by coking coal particles essentially comprises regenerative chambers 51 having a brick checkerwork therein disposed in the lower part thereof and intervening combustion (heating) flues 52 and coking chambers 53 disposed over said regenerative chambers, as shown in a partially exploded-perspective cross-sectional view in FIG. 14. Reference numeral 54 designates a coal charging hole provided in the top of each coking chamber. Reference numeral 55 denotes coke oven doors that close off and open up the entry- and exit-side openings of each coking chamber 53. The coke oven battery heats the coal particles charged into the coking chambers 53 by the combustion gas and air preheated in the regenerative chambers 51 and then burnt in the combustion chambers 52 adjacent to the coking chambers. The waste gas generated in the combustion chamber 52 flows to offtake stacks after passing through exhaust ducts (not shown) provided on the coking chambers 53 and then through flues 56 while heating the brick checkerwork in the regenerative chambers. The coke oven doors closing off and opening up the openings at the pusher and coke sides of the coking chambers are required to have a high enough heat resistance to withstand the high temperature (900° C. or above) at which the coal particles charged into the coking chambers are dry distilled and a high enough sealing ability to prevent the leaking of methane, carbon dioxide, hydrogen and carbon monoxide gases generated therein and the seeping of tar. Coke oven doors comprise approximately 400 mm thick heavy refractory blocks or bricks fitted in the pushing- and delivery-side openings of coking chambers and sealing members shaped like the cross-section of a knife edge pressed onto the door jamb, as disclosed in many Japanese patent gazettes such as Japanese Examined Patent Publication (Koukoku) No. 60-25072 and Japanese Unexamined Utility Model Publication (Kokai) NO. 5-56940. Recently, coke oven doors comprising refractory blocks or bricks adapted to plunge into the pushing- and delivery-side openings of coking chambers through seal plates were developed, as disclosed in Japanese Unexamined Patent Publication (Kokai) No. 2001-288472, and are finding increasing use because of their effect to greatly decrease gas leakage during coking.

Made of heavy refractory blocks or bricks as described above, coke oven doors are capable of withstanding high temperatures and permitting long use. However, the refractory blocks or bricks of the coke oven doors that open up and close off the pushing- and delivery-side openings of coking chambers in every pushing is and release large quantities of heat when opened and absorb large quantities of heat when closed. Therefore, the coal particles charged near the coke oven door plugs are not heated high enough, as a result of which large quantities of undistilled poor-quality coke are generated. Thus it has been said that as much as 1.5 million tons of poor-quality coke are generated in Japan, which means there are a lot of waste of coal particles for the manufacture of coke and loss of heat energy. There have also been many other problems, such as collision and peeling of refractory blocks or bricks, mixing of peeled refractory blocks or brick fragments with coke, thermal damage of the coke oven door structure that might occur if peeled portions are left unrepaired, and removing of peeled blocks or bricks from delivered coke.

Many patent gazettes disclose coke oven doors newly developed with the improvement of coke oven heat efficiency in mind. For example, Japanese Examined Patent Publication (Koukoku) No. 03-40074 (Japanese application filed in 1985) discloses a "method for coking the charge in the coke oven by sending the hot gas generated by said charge to the gas passage through the vertical flue provided in at least one of the doors in contact with said charge and separated from the interior of the coke oven by the thermally conductive metal wall constituting said door and moving part of said hot gas to an upper end region in contact with said partition wall therethrough by the ascending of said gas and the heat conductivity of the partition wall". A "coke oven door carrying on the inner side thereof a shield allowing passage of gases generated in the oven that comprises shielding members made up of spacers and coking plates" disclosed in Japanese Examined Patent Publication (Koukoku) No. 61-49353 (Japanese application filed in 1982) was developed based on the above-described method. Foreign patents similar to above mentioned Japanese patents are as follows. U.S. Pat. No. 4,381,972, U.S. Pat. No. 4,414,072, U.S. Pat. No. 4,467,342. Many other heat-up coke oven doors have been developed, such as a "coke oven door comprising a shield attached to the inner side of the oven wall via fittings to form a space for gas passage and made up of multiple shield members having vertically partitioned U-shaped cross sections" disclosed in Japanese Unexamined Patent Publication (Kokai) No. 62-72782 (Japanese application filed in 1985), a "coke oven door comprising heat-resisting packings attached to both sides of the coke oven walls comprising metal shields provided on the inside of the oven door proper via spacers to form a space for gas passage" disclosed in Japanese Examined Utility Model Publication (Koukoku) No. 06-43146 (Japanese application filed in 1988), and a "coke oven door with ceramic coking plates" disclosed in Japanese Unexamined Utility Model Publication (Kokai) No. 02-69946 (Japanese application filed in 1988). Japanese Examined Patent Publication (Koukoku) No. 05-38795 (Japanese application filed in 1986) discloses a "coke oven door heated by raising the temperature of a gas space provided between a heat insulator attached to the oven door and a heating plate on the inner side of the oven by burning part of combustible gases generated by coking with the air and oxygen blown in from outside".

Also, several coke oven doors having a gas flue to pass the gases generated in the oven or one incorporating a heating burner, in place of the conventional refractory bricks, on the coking chamber side thereof have been introduced as those promoting the temperature increase of coal particles charged near the coke oven doors. For example, Japanese Examined Utility Model Publication (Koukoku) No. 02-26913 and Japanese Unexamined Utility Model Publication (Kokai) No. 06-43146 disclose a coke oven door comprising a metal gas flue shield attached to the oven proper via a heat-insulating box made of a heat-insulating material covered with steel sheet". Japanese Examined Patent Publication (Koukoku) No. 63-112686 discloses a "combustion type coke oven door that burns, in the gas space enclosed by metal shield, part of combustible gases generated during coking cycle with the air or oxygen blown in from outside. These newly developed coke oven doors are expected to decrease the generation of poor-quality coke and tar as they heat the coal particles near the coke oven door plugs by the high-temperature heat of the gases generated in the oven by providing shields or space boxes like gas flues to allow the passage of such gases to the coke oven doors. However, none of them have yet been put into practical use.

Though not certain, the inventor presumes that such coke oven doors have involved the following problems: Conventional space boxes comprise fabricated thin metal shield boxes. The space boxes have such structural problems as deforming under the influence of thermal stresses due to frequent heating and cooling repeated and cracking starting from metal sheet joints and propagating to other areas.

OBJECT OF THE INVENTION

The inventor invented new coke oven doors that permit long stable operation and give enough time to repair coking chamber damages during pushing cycle time by solving the above-mentioned conventional problems such as generation of poor-quality coke near the coke oven doors lined with refractory blocks or bricks and difficulty in use of coke oven doors with hollow type metal plugs.

SUMMARY OF THE INVENTION

Through many experiments and studies intended for the achievement of said object, the inventor discovered that provision of an unwelded chamber to circulate and isolate gases generated in the oven, which comprises a shielding wall made up of vertically and laterally juxtaposed metal shield bars to prevent the inflow of coal particles, with minute slits provided on both sides thereof, on the inner or coking chamber side of the coke oven door allows the large quantities of gases generated in the coke oven and retaining high heat to directly heat the coal particles charged near the coke oven door while flowing through the coal particles to said migration and isolation chamber. The gases generated in the coke oven and flowing into said migration and isolation chamber through said minute slits on both sides of the vertically and laterally juxtaposed shield bars without being inhibited raises the temperature in said migration and isolation chamber and directly heat the coal particles near the coke oven door via said shielding wall of metal shield bars. That is, the inventor discovered that the heating coke oven door sandwiching the coal particles near the coke oven door from between the coke oven and oven door sides promotes heating and coking of the coal particles near the coke oven door and greatly prevents the generation and adhesion of tar.

A coke oven door for promoting temperature increase in the vicinity of door plugs according to the present invention based on the above finding comprises a heat-insulating box provided on the inner side of an oven door structure adapted to open and close a door jamb in the coke oven charged with coal particles via a seal plate pressed against said door jamb, horizontal support frames provided to partition the height of said heat-insulating box into multiple sections, and a bottom-less gas migration and isolation chamber formed by arranging shield bars to prevent the entry of coal particles, laterally and vertically with small ventilating spaces left on both sides thereof, to fill the spaces between said horizontal support frames, with the upper end thereof pivotally fastened to said horizontal support frames. Also, adjoining ends of at least the shield bars to prevent the entry of coal particles arranged on the coke oven side of the bottom-less gas migration and isolation chamber are joined, if required, by stepped joints, with small ventilating spaces left therebetween. A coke oven door to promote temperature rise in the vicinity thereof also may also have the mating ends of the vertically arranged shield bars, i.e. the lower end of said upper bar and the upper end of said lower bar movably joined together by forming notched cross-sections, with a notched mating groove directed toward said gas migration and isolation chamber provided on one of the mating ends and a loosely fitting projection on the other.

A coke oven door to promote temperature rise in the vicinity thereof which comprises a heat-insulating box provided on the inner side of an oven door structure adapted to open and close a door jamb in the coke oven charged with coal particles via a seal plate pressed against said door jamb, upper shield bars fitted in spaces in said heat-insulating box partitioned by horizontal support frames having a slot extending in the direction of oven height and provided in the mating surface of the lower end thereof, lower shield bars having a downward-extending projection adapted to pass through and engaging with said slot and a projecting stopper adapted to come in contact with the lower end of said horizontal support frame provided in the lower end thereof.

A coke oven door to promote temperature rise in the vicinity thereof which comprises a heat-insulating box provided on the inner side of an oven door structure adapted to open and close a door jamb in the coke oven charged with coal particles via a seal plate pressed against said door jamb, horizontal support frames having a rugged engaging portion at the upper edge and provided to partition the height of said heat-insulating box into multiple sections, and a bottom-less gas migration and isolation chamber formed by putting together, both vertically and laterally, shield bars having two separated hooks adapted to engage with the dents on both sides of a projection on said horizontal support frame by stepped joints, with small ventilating spaces provided on both sides thereof and vertical sliding spaces on the projecting side of both stepped joints, and a projecting stopper to prevent the breakoff of the shield bar by coming into contact with said horizontal support frame provided in the lower part of the shield bar.

A coke oven door to promote temperature rise in the vicinity thereof also has a cast-iron box containing a heat-insulating material between the oven door structure and the bottom-less gas migration and isolation chamber.

A coke oven door to promote temperature rise in the vicinity thereof has one or more vertical nozzle pipes separately provided in the bottom-less gas migration and isolation chamber, each of said vertical nozzle pipes comprising a gas nozzle in the upper part, a coal dust chute in the lower part, a combustion gas supply pipe communicating with a combustion gas supply source provided therebetween.

A coke oven door to promote temperature rise in the vicinity thereof has one or more combustion gas injection nozzles separately provided in the bottom-less gas migration and isolation chamber, each of said combustion gas injection nozzles comprising a combustion gas nozzle pipe having in the gas flow passage thereof a nozzle directed toward the bottom-less gas migration and isolation chamber at one end thereof and a downward opening shutter adapted to close a gas passage in the combustion gas supply pipe connected to a combustion gas supply source at the other, a cylinder fastened to the uppermost point of said combustion gas nozzle pipe, said downward opening shutter movably connected via a movable connecting rod to a rod connected to the coke oven side of a piston reciprocating in said cylinder, and a gas flow pipe connecting the combustion gas pipe nozzle between said nozzle and downward opening shutter and the oven door side of said cylinder.

Another coke oven door to promote temperature rise in the vicinity thereof has one or more combustion gas nozzle pipes separately provided in the bottom-less gas migration and isolation chamber, each of said combustion gas injection nozzles comprising a combustion gas nozzle pipe having in the gas flow passage thereof a nozzle directed toward the bottom-less gas migration and isolation chamber at one end thereof and a downward opening shutter adapted to close a gas passage in the combustion gas supply pipe connected to a combustion gas supply source at the other, an ovally shaped annular member whose upper end tilts toward a combustion gas supply source and lower end toward the nozzle, and a downward opening shutter closing an opening in said annular member from the side of the nozzle.

Yet another coke oven door to promote temperature rise in the vicinity thereof has a tar reservoir communicating with the combustion gas passage at one end and having a closing lid at the other is provided below one or more combustion gas supply pipe or combustion gas nozzle pipe separated provided in the bottom-less gas migration and isolation chamber.

PREFERRED EMBODIMENTS OF THE INVENTION

Details of this invention will be described by reference to the drawings.

Figure 1:
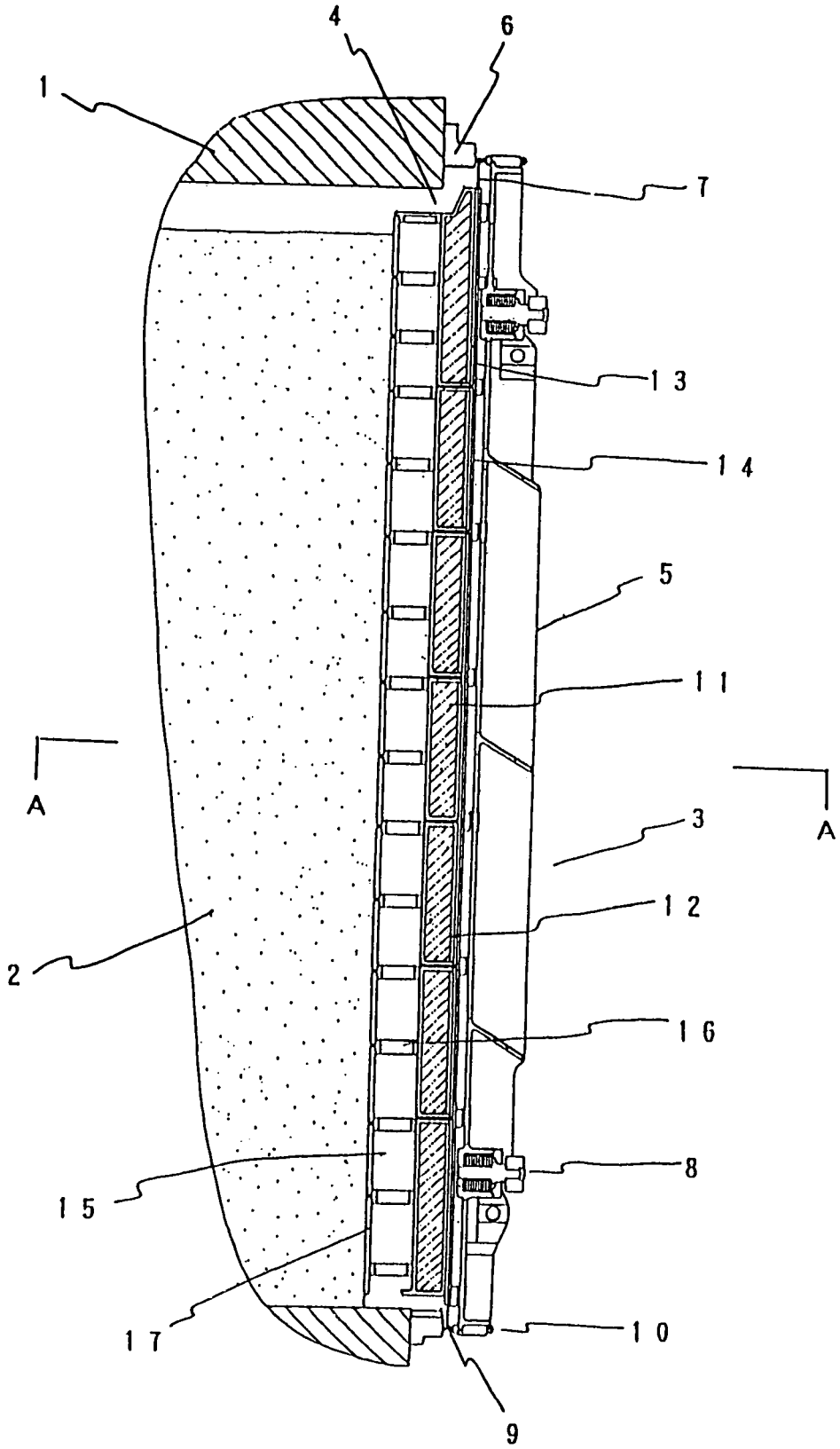
FIG. 1 is a cross-sectional view of a coke oven door according to this invention taken in the direction of oven height.
Figure 2:
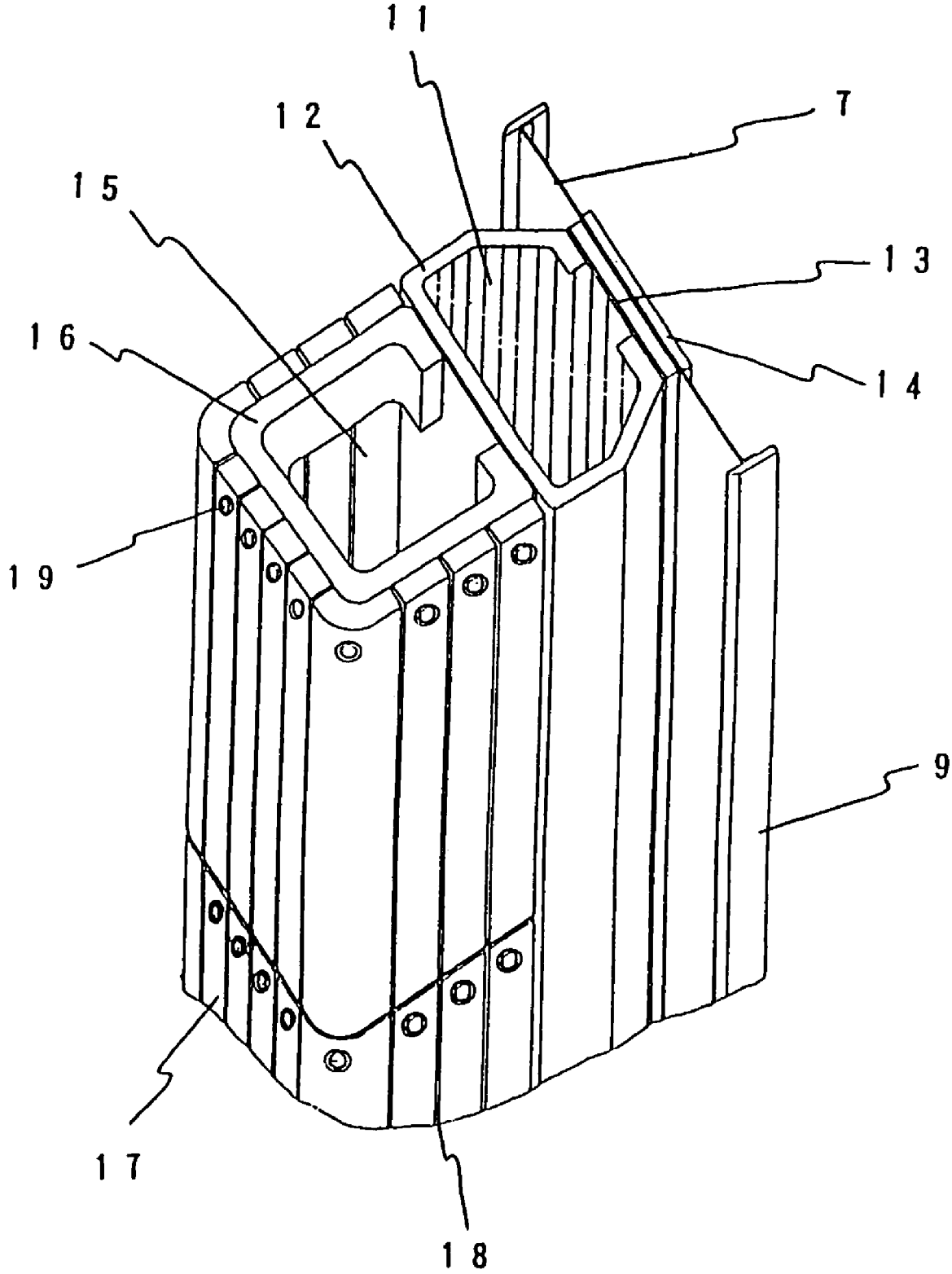
FIG. 2 is a partially omitted, enlarged perspective view taken along the line A-A of FIG. 1.
Figure 3:
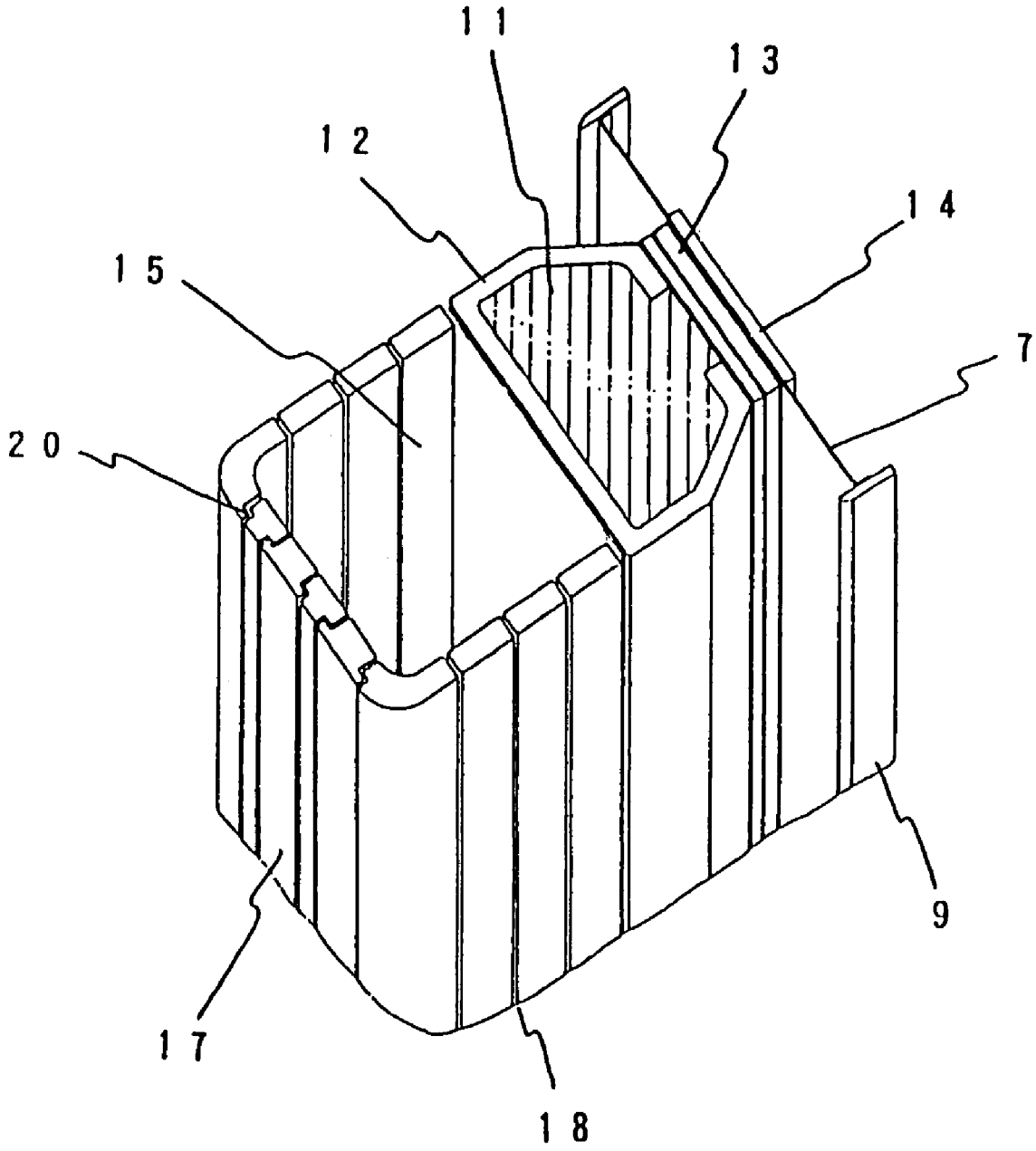
FIG. 3 is a cross-sectional perspective view of another embodiment of this invention in which shield bars to prevent the entry of coal particles are placed one next to another.
Figure 4:
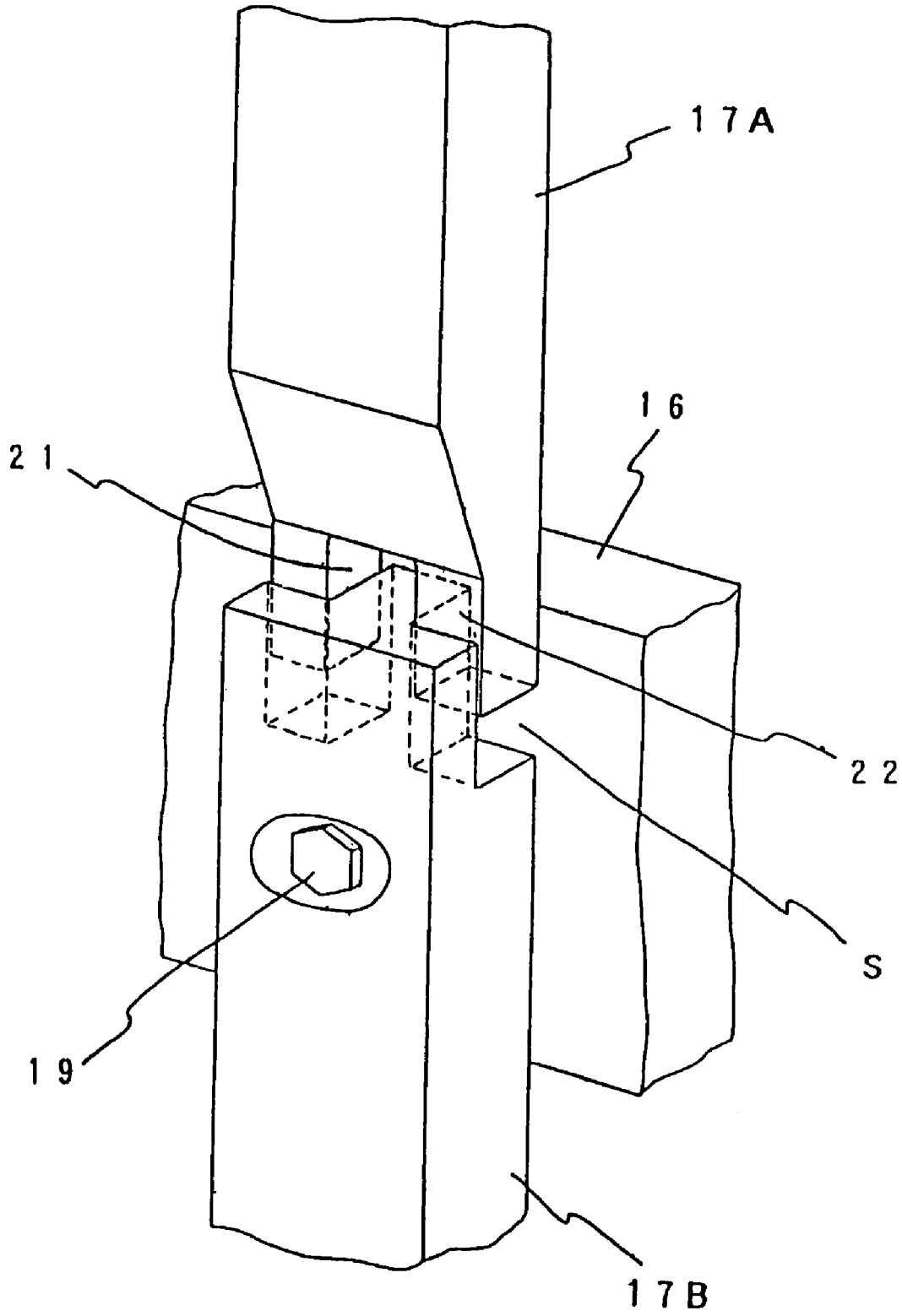
FIG. 4 is a perspective view of a joint mechanism for joining together shield bars to prevent the entry of coal particles placed one on top of another.

FIG. 1 is a cross-sectional view showing an embodiment of this invention in the direction of oven height. FIG. 2 is a partially omitted, enlarged perspective view taken along the line A-A of FIG. 1. In FIG. 1, reference numeral 1 designates a coke oven, 2 coal particles charged in the coke oven 1, 3 an oven door structure that opens and closes an opening 4 in the coke oven 1. The oven door structure 3 comprises a sturdy cast iron frame 5 reinforced with flanges and is adapted to open and close the opening 4 in the coke oven 1 via a seal plate 7 that presses an doorjamb 6 of the coke oven 1. Reference numeral 8 denotes a latch that comprises compression springs, screw bolts and other fastening members and presses and fastens the oven door structure 3 to the opening 4 in the coke oven 1. While a flange member 9 having a knife-edge-shaped cross section is joined to the edge of the seal plate 7, a spring loaded plunger 10, which comprises a cylinder and a spring and presses the flange member 9 to the frame 5, is provided on the oven door structure 3. That is, the oven door structure 3 of this invention is adapted to open and close the opening 4 in the coke oven 1 and press the edge of the seal plate 7 to the frame 6. Reference numeral 11 designates a heat-insulating box that comprises a heat-resistant metal box 12 filled with commonly used heat-insulating refractory materials such as alumina silicate, isolites, carbon woods and ceramics and is attached to the oven door structure 3 via the seal plate 7 or via an inner plate 13 and the seal plate 7 or a slide plate 14. The figure shows an embodiment in which the heat-insulating box 11 is attached with bolts (not shown) to the oven door structure 3 via the inner plate 13, seal plate 7 and slide plate 14. Thus, the heat-insulating box 11 protects the seal plate 7 from heat, prevents the release of heat from the oven door structure 3 and preserves the high-temperature heat possessed by the gas generated in the coke oven 1 and circulating on the oven door side thereof. Also, a bottom-less hollow plug 15 to circulate and isolate the gas having high-temperature heat generated in the coke oven 1 is provided on the coke oven side of the oven door structure 3 via the heat-insulating box 11. The bottom-less hollow plug 15 for gas migration and isolation comprises baggy, cylindrical or other appropriately shaped horizontal support frames 16 made of heat-resisting steel or other heat-resisting metals that do not deform under the pressure of the coal particles 2 charged or other external pressures. The horizontal support frames 16 are fitted in the heat-insulating box 11 in such a manner as to partition the box into several spaces one on top of the other. As shown in FIG. 2, shield bars 17 to prevent the entry of coal particles made of the same material are attached to said horizontal support frames 16, with small ventilating spaces 18 left on both sides of each bar, either vertically and laterally flush with or vertically staggered from one another. The upper ends of said shield bars 17 are pivotally suspended to the horizontal support frames 16 with bolts or other fasteners 19 so as to be capable of returning to the original position when the bars tilt as a result of expansion or collision with other matters. Appropriate metals for the heat-resistant box 12 are not only common stainless steels but also cast irons having small thermal expansion coefficients and high heat-resisting strength that deform very little when subjected to repeated heating and cooling and maintain the original shape for a long time. Though the compositions of cast irons are not particularly limited, it is preferable that carbon content is between 3.0 and 3.8 weight percent in order to obtain hard cast irons comprising a mixture of pearl ite matrix and graphite, silicon content is between 1.5 and 2.5 weight percent in order to decrease shrinkage and increase hardness and tensile strength, and manganese content is between 0.4 and 0.8 weight percent in order to increase hardness and tensile strength. It is also preferable to keep the content of phosphorus, which makes beautiful the skin of cast iron, not more than 0.35 weight percent as phosphorus deteriorates tensile strength and the content of sulfur, which deteriorates castability and toughness, with the rest substantially comprising iron. When the bottom-less hollow plug 15 for allowing migration and isolation of gases generated in the oven is formed by placing the shield bars 17 to prevent the entry of coal particles, it is preferable to form a step on the edges of adjoining bars forming narrow gas flues in order to prevent the entry of coal particles 2 through the ventilating spaces 18 provided on both sides into the gas migration and isolation chamber, as shown in FIG. 3.

When the shield bars 17 to prevent the entry of coal particles are placed vertically and laterally flush, the lower end of the upper bar A and the upper end of the lower bar B may be notched to form engaging steps and slidably joined together, with a space S at least equivalent to the expansion margin of the shield bars 17 between the leading ends thereof. Also, a notched groove 21 and a loosely fitting projection 22 may be provided at the lower and upper ends of the mating shield bars 17. Because the upper and lower shield bars 17 having notched engaging steps are joined together smooth without bulging, the shield bars 17 are neither damaged nor deformed by the impact of falling coke during pushing. The shield bars 17 do not twist or swing through mutual interference, too. Provision of the space S between the leading ends of the adjoining shield bars 17 keeps the expanding shield bars 17, and the hollow plug 15 for gas migration and isolation, in shape for a long time. The profiles of the notched engaging steps are not limited to any particular shape. For example, the shapes of the upper and lower engaging steps illustrated can be interchanged without impairing the effect thereof. It is preferable that the size of the ventilating spaces 18 is determined by considering the expansion margin of the shield bars 17 and the prevention of the entry of coal particles 2. An exhaust pipe to admit and circulate the gases generated in the oven may be provided in the upper part of the bottom-less hollow plug 15 for gas migration and isolation. The bottom-less hollow plug 15 is provided so that the gas generated in the coke oven 1 and admitted through the ventilating spaces 18 on both sides of the shield bars 17 circulate therein and flows out through other ventilating spaces 18 to the coke oven 1 or exhaust pipe.

After the opening 4 of the coke oven 1 is closed by the oven door structure 3 of this invention via the seal plate 7, as in the conventional coking operation, coal particles 2 are charged into the coke oven 1. Heated by the high-temperature heat supplied from an adjoining combustion furnace (not shown), the coal particles 2 charged in the coke oven 1 gradually change into coke. Then, the hot gas generated by the coal particles 2 changed into the middle of the coke oven 1 flows toward the shield bars 17, heats the coal particles 2 near the shield bars 17 that have not reached the coking temperature, and flows into the bottom-less hollow plug 15 for gas migration and isolation through the ventilating spaces 18 on both sides of the shield bars 17. The bottom-less hollow plug 15 for gas migration and isolation heated to high temperature by the incoming gas from the coke oven heats the coal particles 2 near the coke oven door via the shield bars 17. Thus, the coal particles 2 charged near the coke oven door is heated when the gas generated in the oven flows from the middle of the coke oven 1 to the bottom-less hollow plug 15 for gas migration and isolation, and indirectly by the heat released from the heated bottom-less hollow plug 15 for gas migration and isolation through the shield wall.

That is to say, the coke oven door structure according to this invention is designed to heat the coal particles 2 charged near the oven door from the coke oven side and the oven door side. Thus, the oven door according to this invention promotes coking of the coal particles near the oven door and brings the temperature thereof faster than in conventional coke ovens to the coking temperature following the heating rate of the coal particles 2 charged in the middle of the coke oven 1. The coal particles 2 unavoidably admitted through the ventilating spaces 18 are either gasified without yielding tar or naturally let out through the lower part of the bottom-less gas migration and isolation hollow plug 15.

The adjoining shield bars 17 placed at least on the coke oven side of the gas migration and isolation hollow plug 15 form a narrow ventilating space 18 by mating together the stepped ends thereof, thereby blocking the entry of the coal particles 2, preventing the yielding and solidification of tar in the gas migration and isolation hollow plug 15, allowing the passage of only the gas generated in the oven, and promoting heating.

Figure 5:
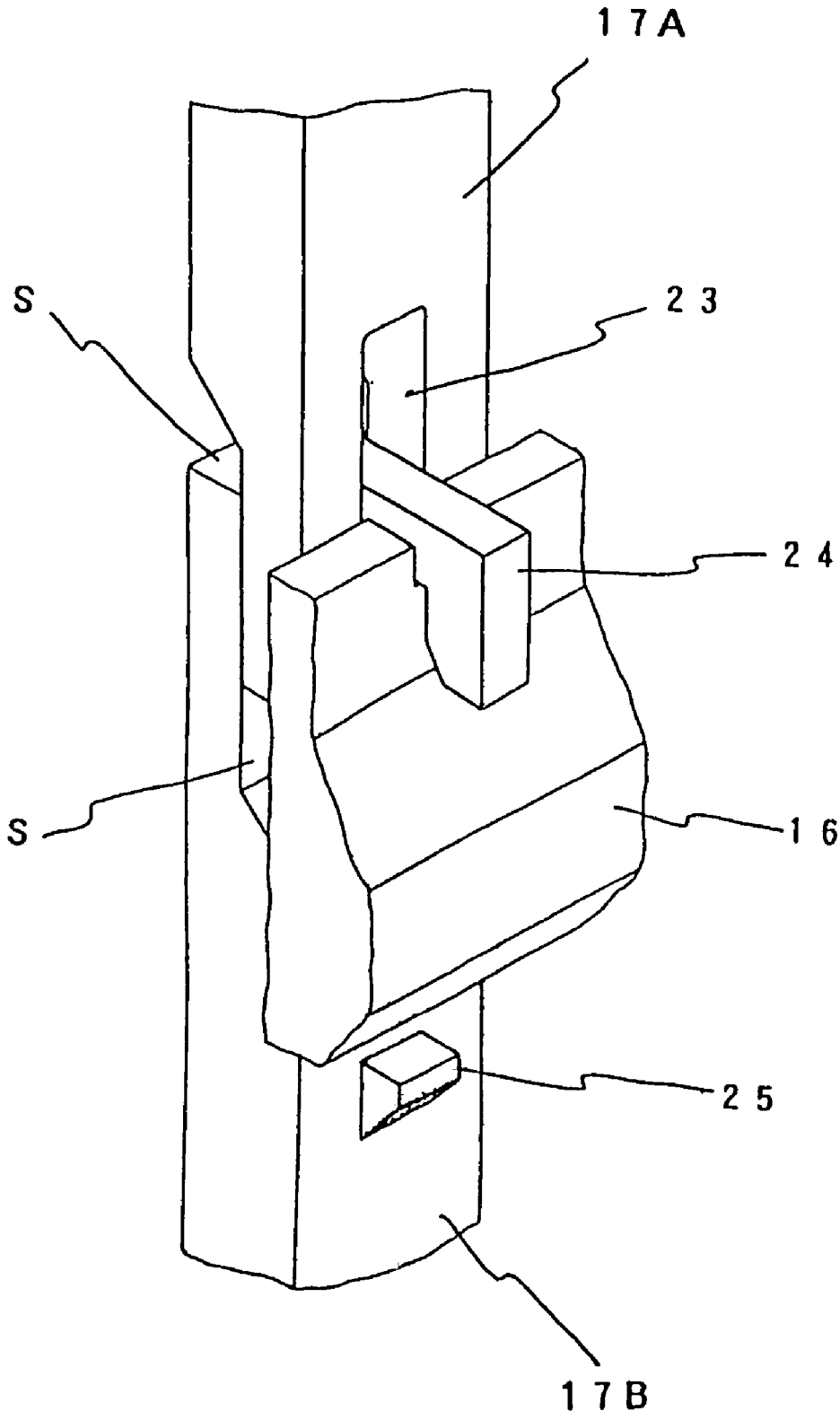
FIG. 5 is a perspective view of a fastening mechanism for fastening together shield bars to prevent the entry of coal particles placed one on top of another.
Figure 6:
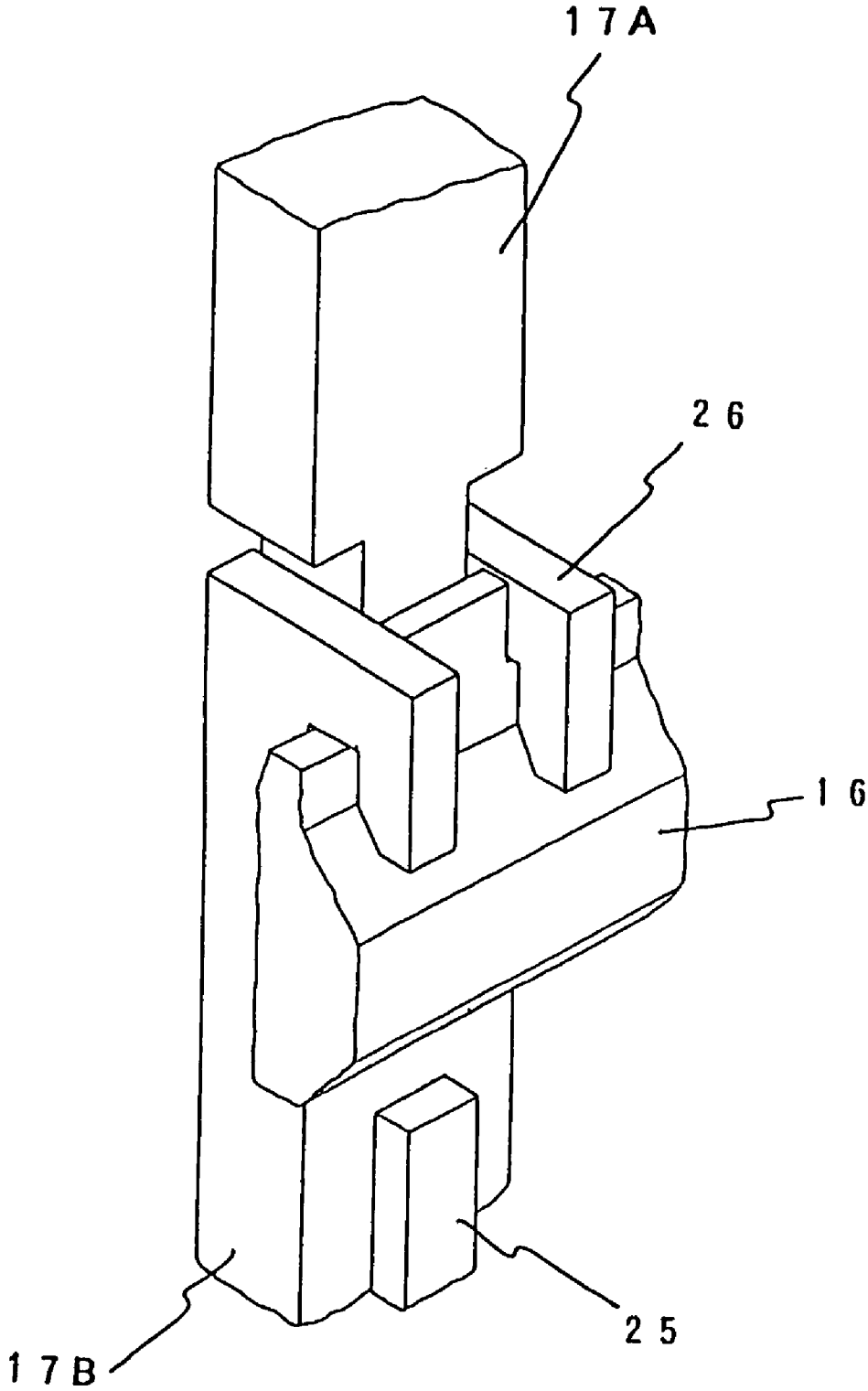
FIG. 6 is a perspective view of a fastening mechanism for fastening together shield bars to prevent the entry of coal particles placed one on top of another.

The fasteners 19 used for suspending the shield bars 17 becomes burnt in the course of long use or will require considerable time and trouble for removing if chance for replacement is missed. FIGS. 5 and 6 are perspective views of vertically joining structures that permit easy replacement of the shield bars 17.

In FIG. 5, an upper shield bar 17A and a lower shield bar 17B are slidably joined together via smooth notched ends thereof, with a space S left therebetween. While a slot 23 extending in the direction of oven height is provided in the mating surface of the upper shield bar 17A, a downward-extending projection 24 adapted to pass through and engage with said slot 23 is provided at the upper end of the mating surface of the lower shield bar 17B. Also, a projecting stopper 25 adapted to come into contact with the horizontal support frame 16, thereby preventing the breakoff of the lower shield bar 17B that is pushed up too high, is provided in the lower part of the mating surface thereof.

Figure 7:
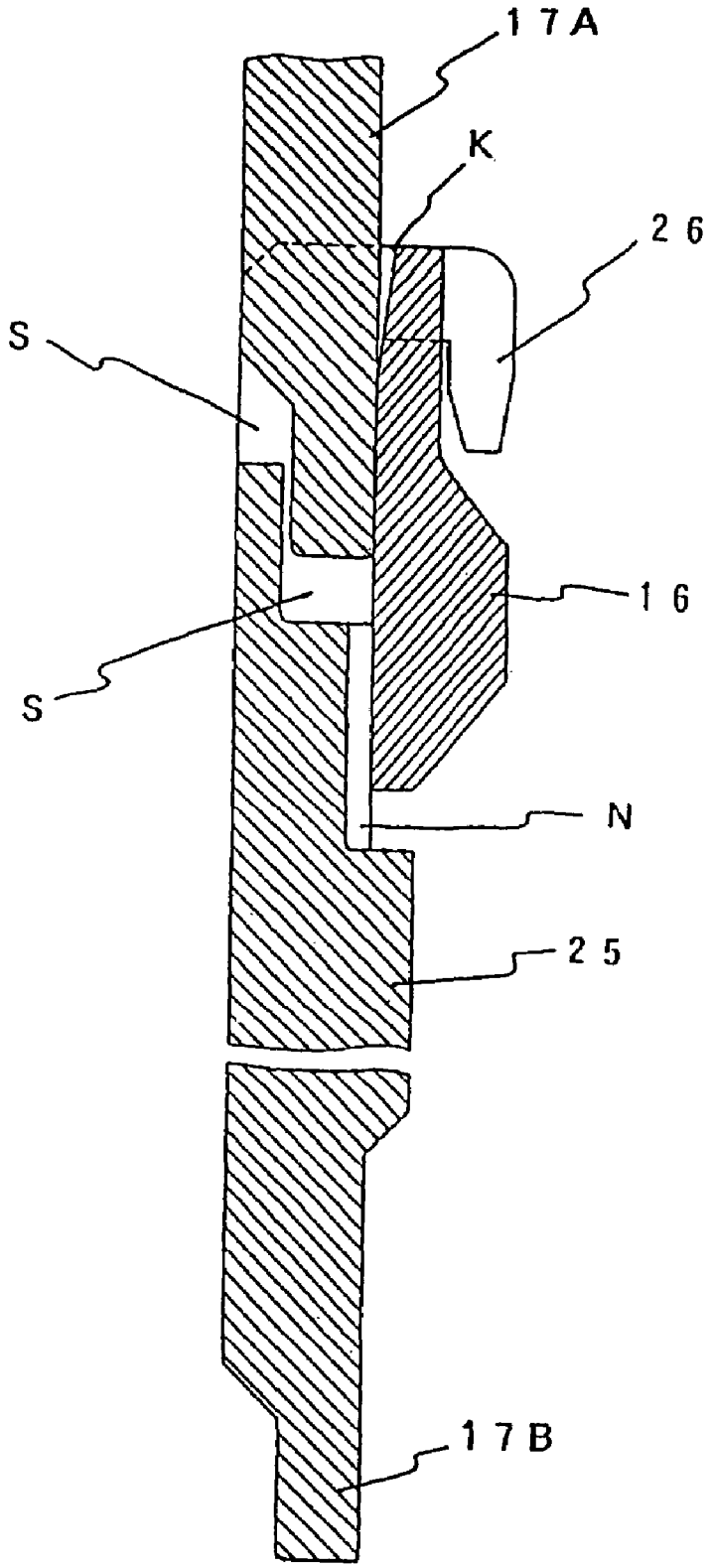
FIG. 7 is a cross-sectional view of the fastening mechanism shown in FIG. 6 taken in the direction of oven height.
Figure 8:
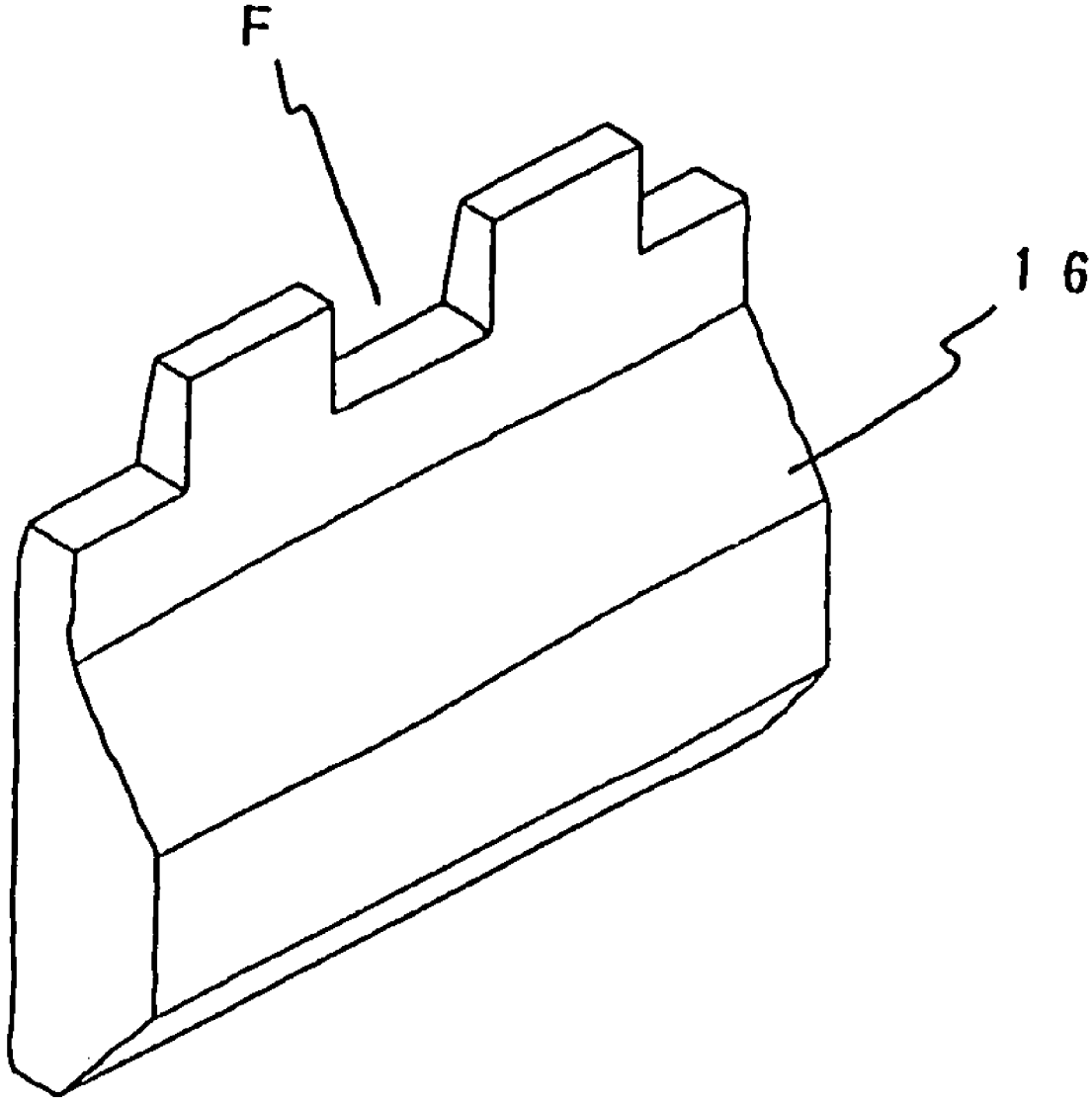
FIG. 8 is a perspective view of a horizontal support frame used in the fastening mechanism of FIG. 6.

When one or more shield bars 17 engaging with the horizontal support frame 16 and forming the gas migration and isolation hollow plug 15 become unsuitable for use because of deformation or damage, the downward-extending projection 24 is pulled out of the horizontal support frame 16 or removed by turning upward from below after the lower shield bar 17B is pushed up from below along the slot 23 in the upper shield bar 17A. FIGS. 6, 7 and 8 show another type of vertically engaging mechanism that permits individually removing each of the shield bars 17 forming the gas migration and isolation hollow plug 15.

FIG. 6 is a perspective view of a fastening mechanism for engaging a shield bar 17 with a horizontal support frame 16. FIG. 7 is a cross-sectional view of the fastening mechanism shown in FIG. 6 taken in the direction of oven height. FIG. 8 is a perspective view of a horizontal support frame 16 provided in the heat-insulating box 11. The horizontal support frame 16 has a rugged engaging part F. Although the cross-sectional profile of the horizontal support frame is not limited to any particular shape, the swollen tabular profile shown in the figures having a great load-carrying power is preferable for fastening the shield bars 17 and maintaining the stable shape of the gas migration and isolation hollow plug 15.

Two separated hooks 26 adapted to engage with recesses on both sides of a projection on the horizontal support frame 16 are provided at the upper end of the shield bar 17 to restrain the lateral motion of said bar. The lower end of the upper shield bar 17A and the lower shield bar 17B having the two separated hooks 26 at the upper end thereof are engaged together by stepped joints. A space S at least equivalent to the expansion margin of the shield bars 17 is provided between the leading ends of the upper and lower shield bars, as with the embodiment shown in FIG. 5, to accommodate the elongation of the longitudinally expanding shield bars 17 and maintain the shape of the gas migration and isolation hollow plug 15.

Also, a projecting stopper 25 to prevent the breakoff of the shield bar 17 from the horizontal support frame 16 when the shield bar 17 is pushed up too high is provided in the lower part of the mating surface thereof.

As with the joint structure shown in FIG. 5, this joint structure permits removing the damaged shield bar 17 by turning outward from below. Though not particularly limited, a tapered K-shaped profile may be formed at the upper end of the horizontal support frame 16 so as to facilitate the removal of the shield bar 17. Also, a tar drain groove N leading to said space S may be provided on the horizontal support frame side of the lower shield bar 17B to permit natural outflow of the tar collecting in the space S.

The vertical joint structure shown in FIG. 6 is assembled, like the one shown in FIG. 5, so that the damaged shield bar 17 can be easily removed from the horizontal support frame 16 by pulling or turning upward from below. Even if the joint structure of the shield bars 17 changes, as shown in FIG. 5 or 6, coking operation is carried out as in the conventional way.

Figure 9:
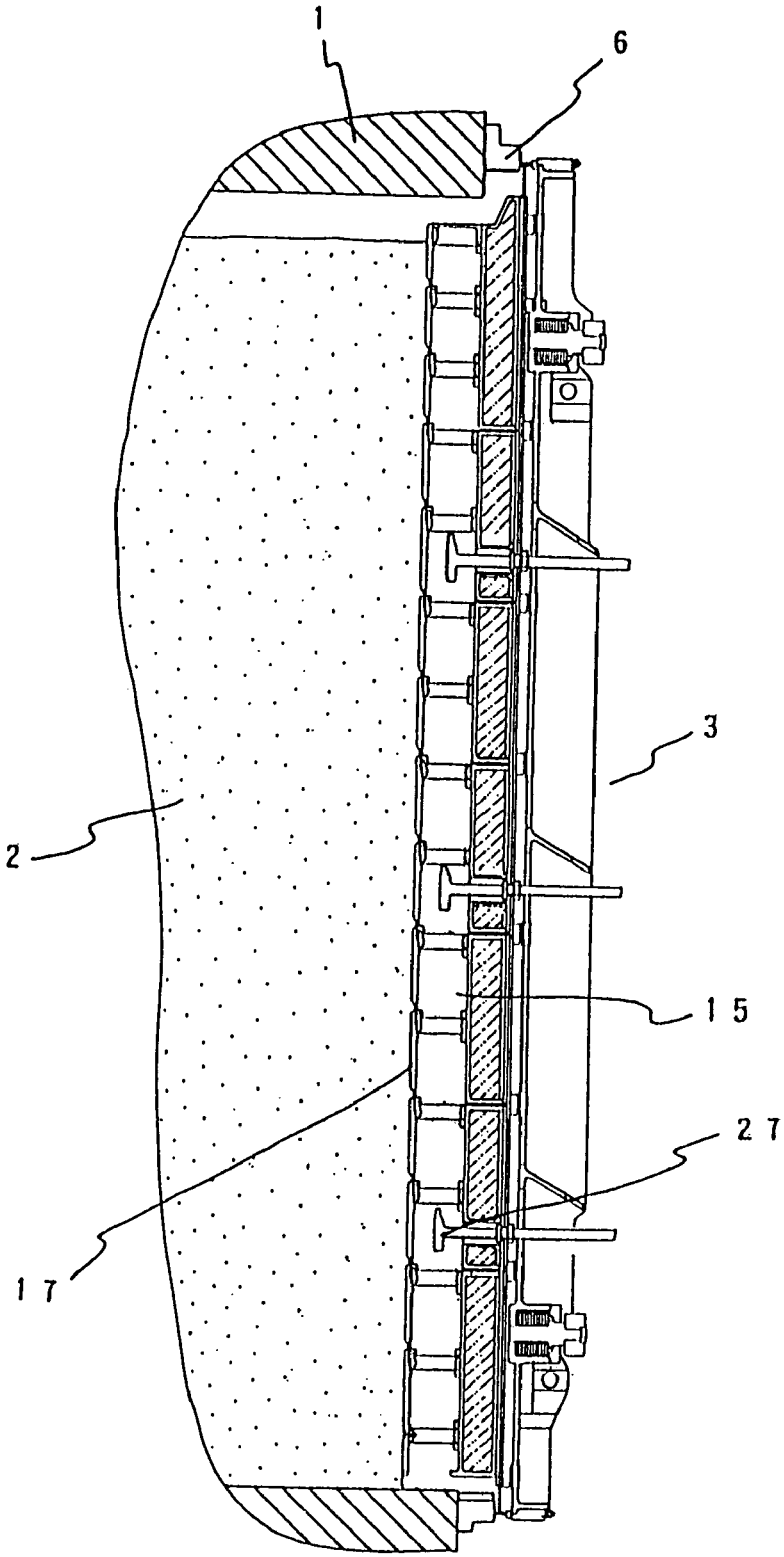
FIG. 9 is a cross-sectional view of another embodiment of this invention with a bottom-less chamber for allowing migration and isolation of gases generated in the oven having a vertical nozzle pipe provided in the direction of oven height.
Figure 10:
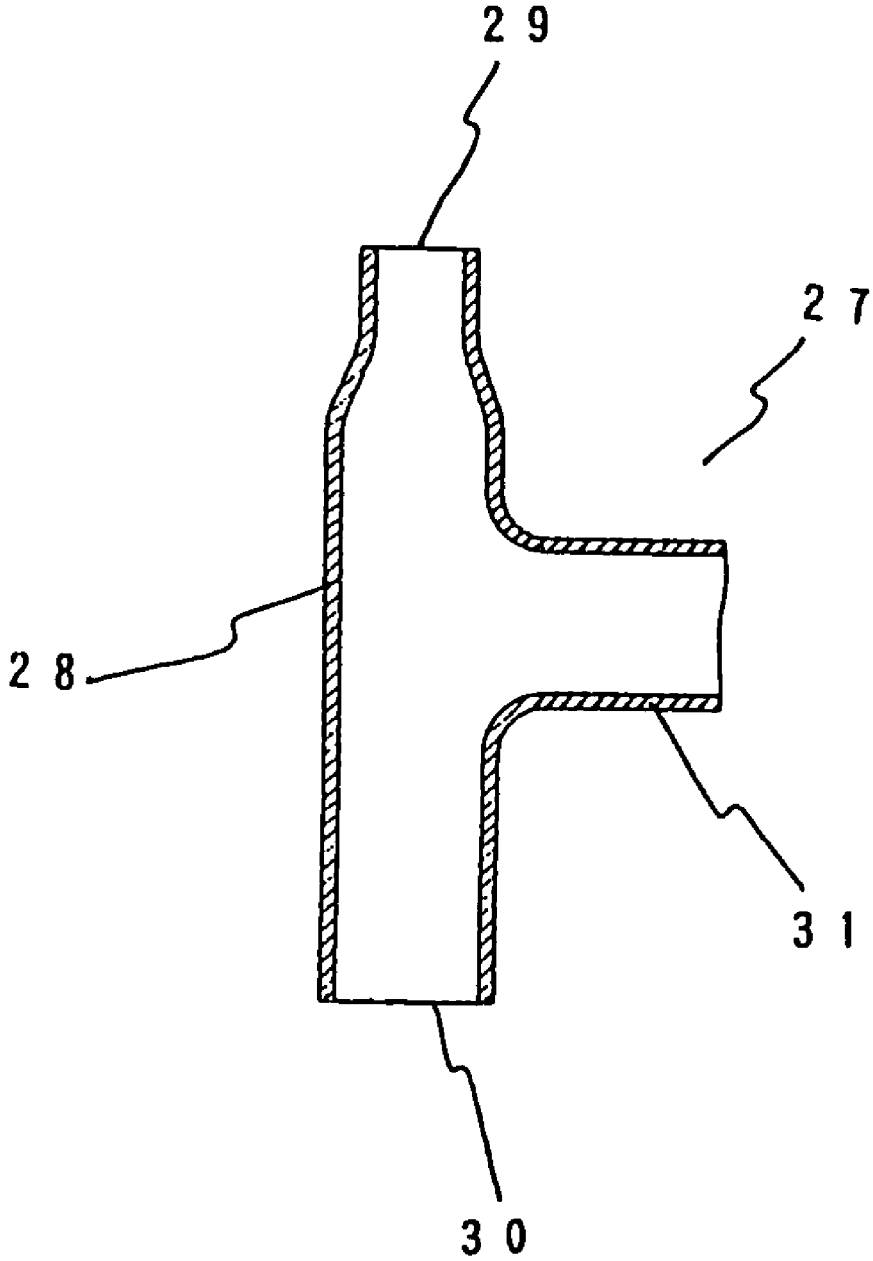
FIG. 10 is an enlarged cross-sectional view of the vertical nozzle pipe shown in FIG. 9.

In order to further temperature rise and prevent tar generation in the bottom-less gas migration and isolation hollow plug 15, one or more vertical nozzle pipes 27 to blow out air, oxygen or other combustible gases to burn the gases generated in the oven and circulating in the gas migration and isolation hollow plug 15, at certain intervals in the direction of oven height, as shown in FIG. 9. A nozzle 29 formed by constricting, as shown in FIG. 10, the upper end of a vertical pipe 28, which constitutes a portion of the vertical nozzle pipe 27, prevents the accumulation of coal particles unavoidably entering the gas migration and isolation hollow plug 15 and the resulting yielding or tar. An unconstricted lower end 30 allows the coal particles admitted into the vertical pipe 28 to fall without sticking to the inner wall thereof, thus preventing the clogging thereof. That is, the vertical nozzle pipe 27 has a clogging-free structure that permits the combustion gas supplied from a gas supply source (not shown) through a combustion gas supply pipe 31 connected to the midpoint thereof to issue stably for a long time.

The coke oven doors having the vertical nozzle pipes 27 permit carrying out ordinary coking operation while constantly blowing out air or other combustion gases. Also, the quantity of combustion gas for burning the gases generated in the coke oven 1 and admitted into the gas migration and isolation hollow plug 15 can be controlled by controlling the pressure therebetween.

Figure 11:
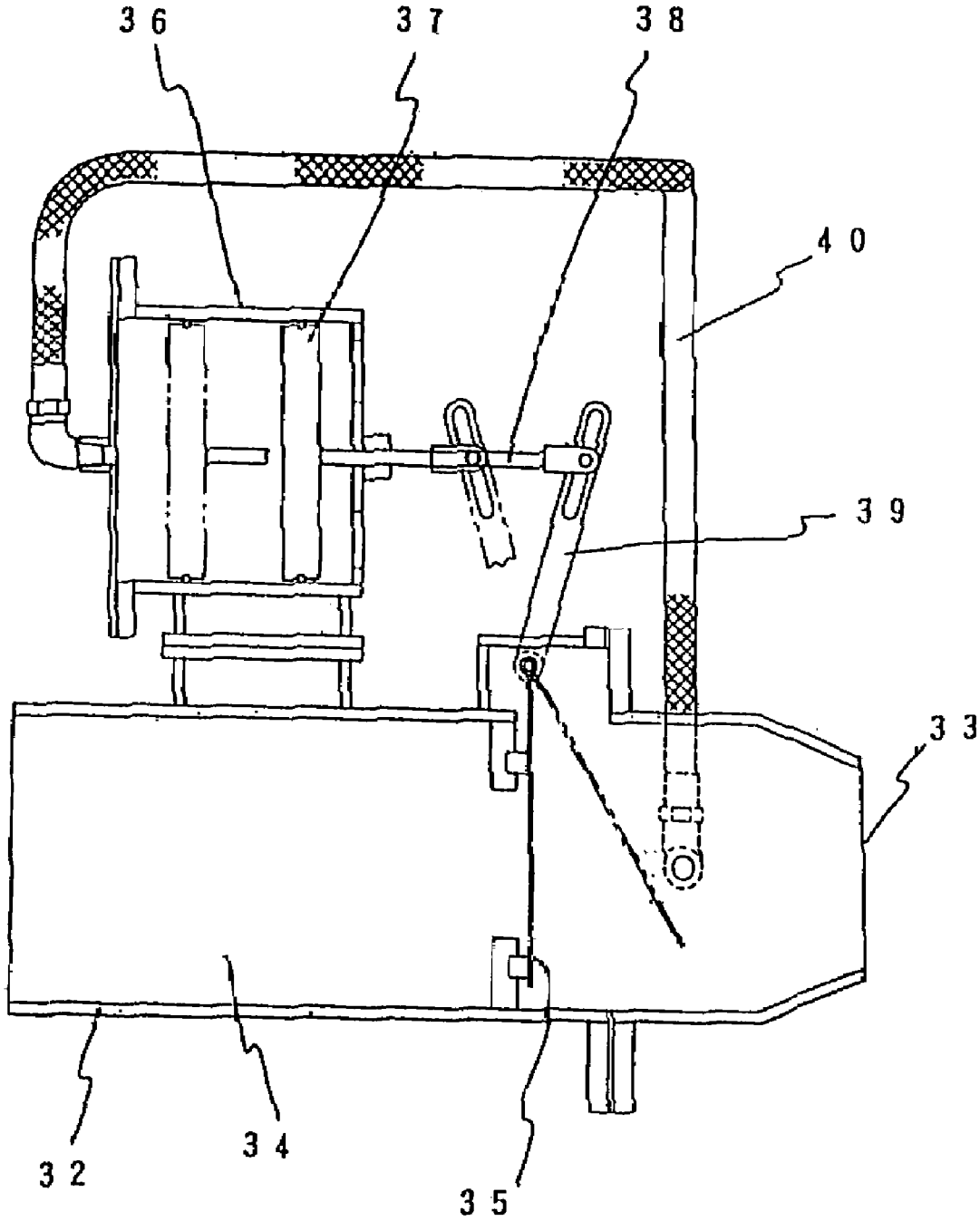
FIG. 11 is an enlarged cross-sectional view of a burning gas nozzle provided in the bottom-less chamber for allowing migration and isolation of gases generated in the oven.

One or more combustion gas injection nozzles of the type shown in FIG. 11 may be provided, at certain intervals in the direction of oven height, in the bottom-less gas migration and isolation hollow plug 15 so as to permit automatic supply of the combustion gas in accordance with pressure changes therein. Reference numeral 32 in FIG. 11 designates a combustion gas supply pipe. While a nozzle 33 directed to the gas migration and isolation hollow plug is provided at one end of the combustion gas supply pipe 32, a combustion gas supply source (not shown) is connected to the other end thereof. Besides, a downward opening shutter 35 to cut off the flow of the gases from the nozzle 33 to the gas supply source is provided in a gas passage 34. A cylinder 36 is fastened to the uppermost point of the combustion gas supply pipe 32. Said downward opening shutter 35 is pivotally connected via a connecting rod 39 to a rod 38 that is connected to the coke oven side of a reciprocating piston 37 sliding in said cylinder 36. A gas migration pipe 40 connects the combustion gas supply pipe 32 between the nozzle 33 and downward opening shutter 35 to the oven door side of the cylinder 36. When the gas migration and isolation hollow plug 15 on the side of the nozzle 33 is filled with a large quantity of gas and the pressure therein rises, the combustion gas injection nozzles moves the rod 38 via the gas migration pipe 40. Then, the connecting rod 39 tilts to move the downward opening shutter 35 from a position indicated by a two-dot chain line to a position indicated by a solid line, thereby closing the combustion gas supply pipe 32. When, by contrast, the gas flowing into the gas migration and isolation hollow plug 15 decreases and the pressure therein drops, the downward opening shutter 35 moves from the position indicated by the solid line to the position indicated by the two-dot chain line to open the combustion gas supply pipe 32, whereupon the combustion gas from the gas supply source flows through the nozzle 33. The coke oven door having the combustion gas injection nozzle in the gas migration and isolation hollow plug 15 is also permit carrying out the ordinary coking operation described earlier.

Figure 12:
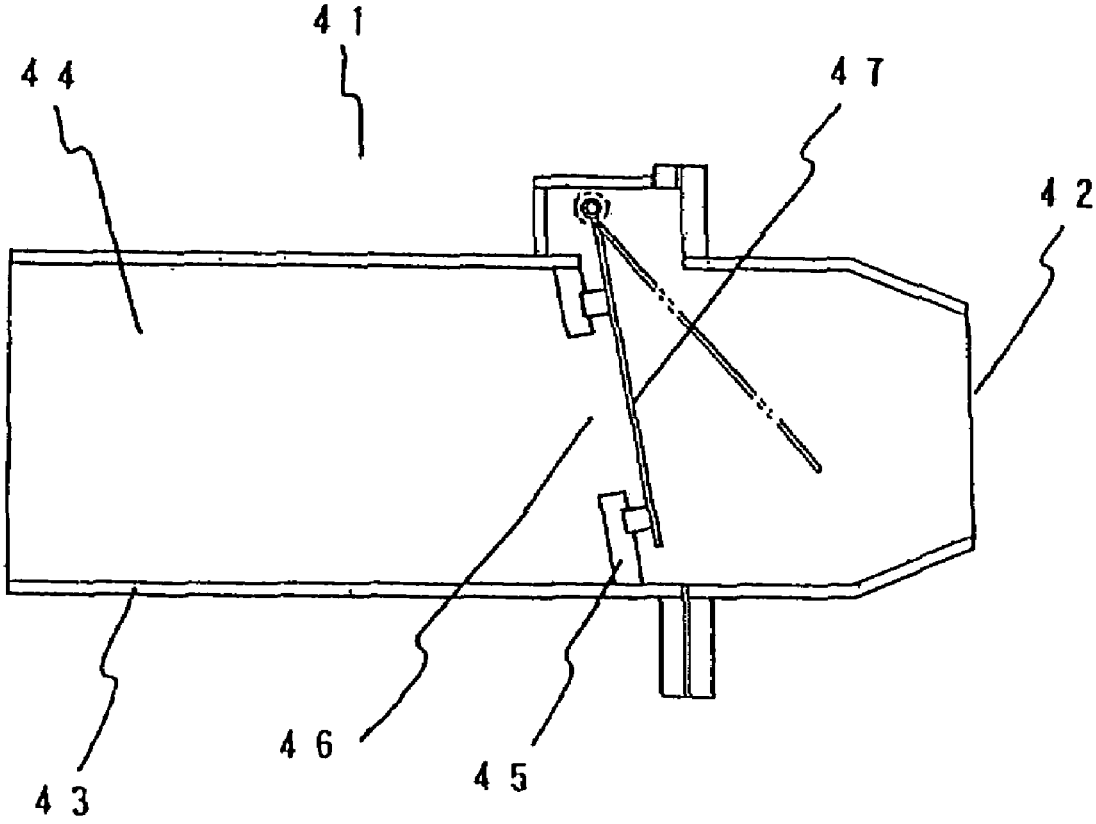
FIG. 12 is an enlarged cross-sectional view of a burning gas nozzle provided in the bottom-less chamber for allowing migration and isolation of gases generated in the oven.

The coke oven door of this invention may also have a combustion gas nozzle pipe 41 of the type shown in FIG. 12 to permit automatic supply of combustion gas when the pressure in the bottom-less gas migration and isolation hollow plug 15 drops While a nozzle 42 fitted into the bottom-less gas migration and isolation hollow plug 15 is provided at one end, an ovally shaped annular member 45 whose upper end tilts toward a combustion gas supply source and lower end toward the nozzle is provided in a gas passage 44 in a combustion gas supply pipe 43 connected to the combustion gas supply source (not shown). An opening 46 in the annular member 45 is closed from the side of the nozzle 42 by a downward opening shutter 47. One or more combustion gas nozzle pipes 41 just described are provided in the gas migration and isolation hollow plug 15, at certain intervals in the direction of oven height. When the pressure of the gas on the side of the nozzle 42 or in the bottom-less gas migration and isolation hollow plug 15 is high, the downward opening shutter 47 closes the gas passage 44 in the combustion gas supply pipe 43 to stop the supply of the combustion gas. When, by contrast, the pressure of the gas in the bottom-less gas migration and isolation hollow plug 15 is lower than that of the combustion gas, the downward opening shutter 47 is pushed open (and retreats to the position indicated by a two-dot chain line), whereupon a large quantity of combustion gas flows into the bottom-less gas migration and isolation hollow plug 15 through the nozzle 42. The quantity of combustion gas supplied can be controlled by controlling the gas supply from the gas supply source, reducing the weight of the downward opening shutter 47 suspended from the upper part of the combustion gas supply pipe 43, or adjusting the angle of inclination of the annular member 45 against which the downward opening shutter 47 rests.

Figure 13:
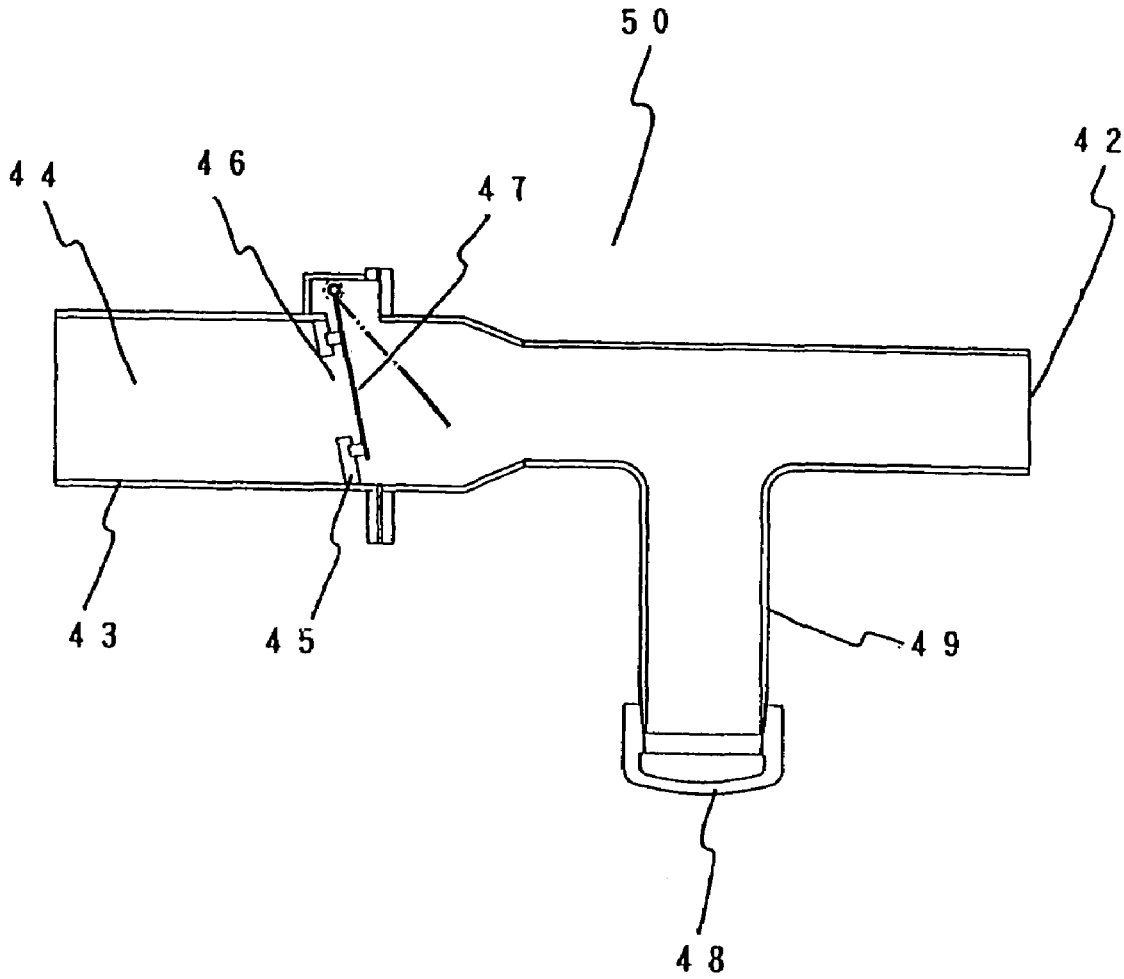
FIG. 13 is a scaled-down view of another burning gas nozzle pipe in which a tar container is provided in the nozzle-side burning gas flue of the burning gas nozzle pipe shown in FIG. 12.
Figure 14:
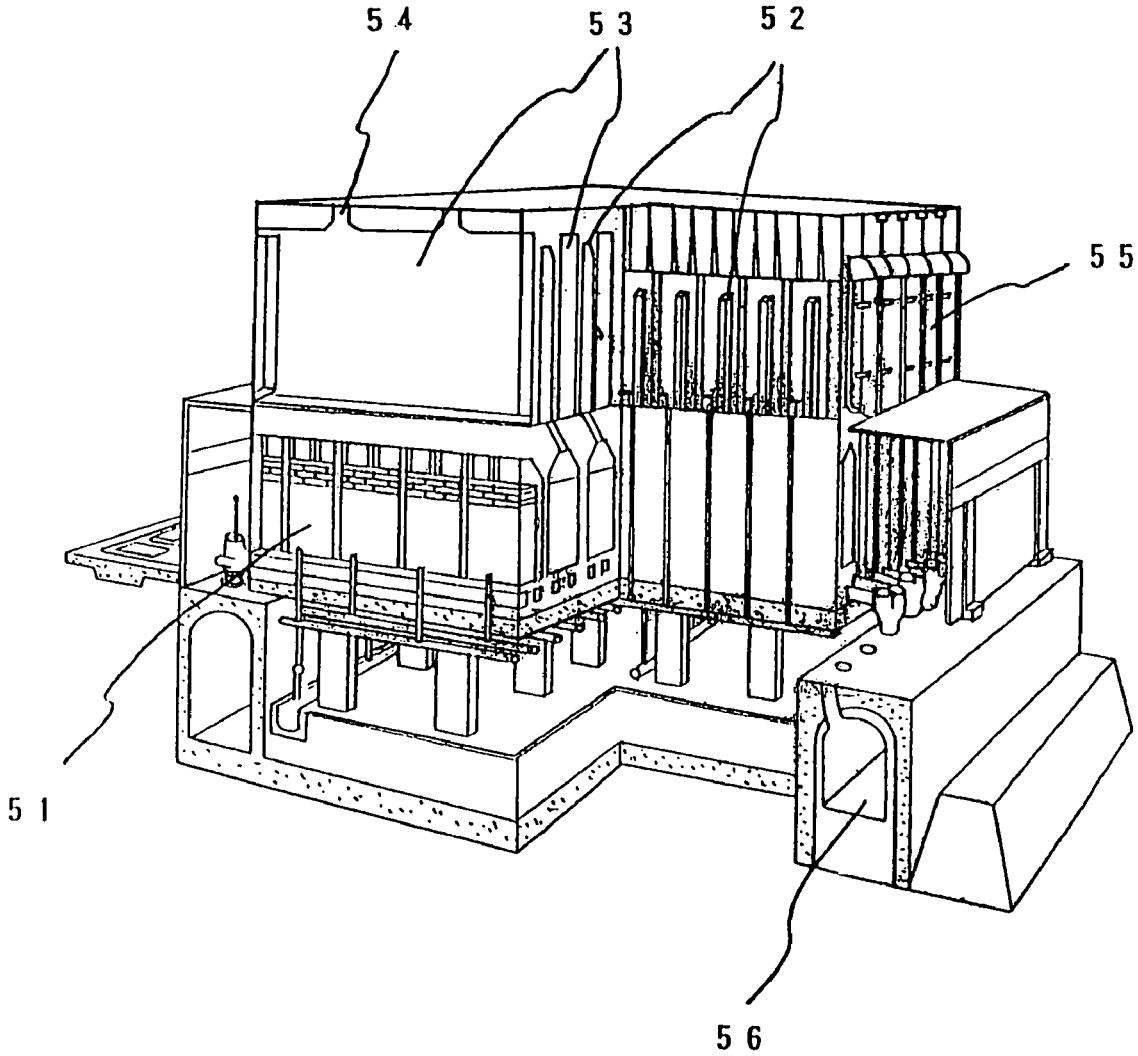
FIG. 14 is a partially exploded perspective view of the basic structure of a conventional coke oven.

Because the combustion gas supply pipe 32 shown in FIG. 11 or 41 shown in FIG. 12 is used in environments where fine coal particles float, the following problem might arise. When, for example, the combustion gas nozzle pipe 41 of the type shown in FIG. 12 is used for a long time, the fine coal particles admitted to the bottom-less gas migration and isolation hollow plug 15 enters the combustion gas passage on the nozzle side of the combustion gas supply pipe 43 when the supply of the combustion gas is stopped. The accumulated coal particles sludged by the coking heat or the tar solidified therefrom clog the nozzle and prevents the continuation of gas supply. Another combustion gas nozzle pipe shown in FIG. 13 solves the above problem. A combustion gas nozzle pipe 50 shown in FIG. 13 comprises a combustion gas nozzle pipe 43 that is similar to the combustion gas nozzle pipe 41 shown in FIG. 12. FIG. 13 shows a combustion gas nozzle pipe 50 that has a tar reservoir 49 of heat-resisting pipe or other container whose one end communicates with the combustion gas passage 44 in the combustion gas supply pipe 41 that constitutes the combustion gas nozzle pipe 41 shown in FIG. 12 and the other is closed by a lid 48. The tar reservoir 49 is provided on the side of the nozzle 42 and below the combustion gas passage 44. This coke oven cover heating the vicinity thereof has one or more combustion gas nozzle pipes of the type just described in the bottom-less gas migration and isolation hollow plug 15, at certain intervals in the direction of oven height. The tar reservoir 49 in FIG. 13 may be formed by tapering the lower side of the combustion gas supply pipe 43 in such manner as to facilitate the collection of the tar generated on the side of the nozzle 42 in the combustion gas passage 44. The lid 48 provided to facilitate the removal of the collected tar is fastened by thread screw, hinge or other common fastening mechanisms.

If it is necessary to positively burn the gas entering and circulating in the bottom-less gas migration and isolation hollow plug 15, an ignition device may be provided near the exit of the constricted nozzle 29 in FIG. 10, nozzle 33 in FIG. 11 and nozzle 42 in FIGS. 12 and 13.

INDUSTRIAL APPLICABILITY

As described above, the coke oven doors according to this invention have a gas migration and isolation hollow plug formed by suspending shield bars to prevent the entry of coal particles on the coke oven side thereof. The coal particles charged near the coke oven door are heated from both sides by the high-temperature gas generated from the coal particles charged in the middle of the coke oven and the heat possessed by the shield bars heated by the gas generated in the coke oven and admitted into said gas migration and isolation hollow plug. Therefore, the coke oven doors according to this invention significantly reduce the generation of poor-quality coke and yield uniform quality coke. Because the tar produced in the low temperature phase of coking is decomposed by the subsequent rapid temperature rise and remains so little that tar cleaning after each pushing can be finished in a short time. As the gas migration and isolation hollow plug is formed by assembling removable independent shield bars, both vertically and laterally, severely damaged shield bars can be easily replaced and quickly repaired. Also, the tar clogging the ventilating spaces can be easily removed by moving or scrubbing the shield bars in the clogged region. Made of heat-resisting metal members, the shield bars can be reused by machining damaged parts or straightening deformed parts. Even when replaced and scrapped, the shield bars can be recycled as materials for steelmaking.

What is claimed is:

1. A coke oven door to promote temperature rise in a vicinity thereof, comprising:

a heat-insulating box provided on an inner side of an oven door structure adapted to open and close a door jamb in the coke oven charged with coal particles via a seal plate pressed against said door jamb;

horizontal support frames fitted to a coking chamber side of the heat-insulating box and spaced apart with spaces therebetween to partition a height of said heat-insulating box into multiple sections; and a bottom-less gas migration and isolation chamber formed by shield bars arranged laterally and vertically to span the spaces between said horizontal support frames and so arranged with ventilating spaces being present between laterally adjacent ones of said shield bars, said ventilating spaces being sufficiently small to prevent passage of coal particles, an upper end of each of the shield bars being pivotally fastened to said horizontal support frames.

2. A coke oven door according to claim 1, wherein adjoining ends of at least a portion of the shield bars which are arranged on the coke oven side of the bottom-less gas migration and isolation hollow plug are joined by stepped joints, with said ventilating spaces left therebetween.

3. A coke oven door according to claim 1, wherein mating ends of vertically adjacent ones of said shield bars which include a lower end of an upper shield bar of said vertically adjacent ones of shield bars and an upper end of a lower shield bar of said vertically adjacent ones of said shield bars which is mounted vertically below said upper shield bar are movably joined together by forming notched cross-sections, with a notched mating groove directed toward said gas migration and isolation hollow plug provided on one of the mating ends and a loosely fitting projection on an other of the mating ends.

4. A coke oven door to promote temperature rise in a vicinity thereof, comprising:

a heat-insulating box provided on an inner side of an oven door structure adapted to open and close a door jamb in the coke oven charged with coal particles via a seal plate pressed against said door jamb;

horizontal support frames fitted to a coking chamber side of the heat-insulating box and spaced apart with spaces therebetween to partition a height of said heat-insulating box into multiple sections; and shield bars fitted in the spaces between said horizontal support frames and arranged with ventilating spaces being present between laterally adjacent ones of said shield bars, said ventilating spaces being sufficiently small to prevent passage of coal particles, said shield bars including upper shield bars each having a slot extending in a direction of oven height and provided in a mating surface of a lower end thereof, said shield bars further including lower shield bars each having a downward-extending projection adapted to pass through and engage with said slot and a projecting stopper in a lower position thereof adapted to come in contact with the lower end of an associated one of said horizontal support frames.

5. A coke oven door to promote temperature rise in a vicinity thereof, comprising:

a heat-insulating box provided on an inner side of an oven door structure adapted to open and close a door jamb in the coke oven charged with coal particles via a seal plate pressed against said door jamb;

horizontal support frames having a rugged engaging portion at an upper edge thereof which include recesses on both sides of a projection, said horizontal support frames being spaced apart with spaces therebetween to partition a height of said heat-insulating box into multiple sections; and a bottom-less gas migration and isolation hollow plug formed by putting together shield bars, both vertically and laterally, to span the spaces between said horizontal support frames and so arranged with ventilating spaces being present between laterally adjacent ones of said shield bars, said ventilating spaces being sufficiently small to prevent passage of coal particles, said shield bars having two separated hooks adapted to engage with the recesses on both sides of said projection on said horizontal support frame by stepped joints and vertical sliding spaces on a projecting side of both stepped joints, and a projecting stopper to prevent breakoff of a one of the shield bars by coming into contact with said horizontal support frame provided in a lower part of the shield bar.

6. A coke oven door according to claim 1, wherein said heat insulating box includes a cast-iron box containing a heat-insulating material which is provided between the oven door structure and the bottom-less gas migration and isolation hollow plug.

7. A cake oven door according to claim 1, further comprising one or more vertical nozzle pipes which are separately provided in the bottom-less gas migration and isolation hollow plug, each of said vertical nozzle pipes comprising a gas nozzle in the upper part, a coal dust chute in the lower part, a combustion gas supply pipe communicating with a combustion gas supply source provided therebetween.

8. A coke oven door to promote temperature rise in a vicinity thereof, comprising:

a heat-insulating box provided on an inner side of an oven door structure adapted to open and close a door jamb in the coke oven charged with coal particles via a seal plate pressed against said door jamb;

horizontal support frames spaced apart with spaces therebetween being provided to partition a height of said heat-insulating box into multiple sections;

a bottom-less gas migration and isolation chamber formed by shield bars arranged laterally and vertically to span the spaces between said horizontal support frames and so arranged with ventilating spaces being present between laterally adjacent ones of said shield bars, said ventilating spaces being sufficiently small to prevent passage of coal particles, an upper end of each of the shield bars being pivotally fastened to said horizontal support frames; and one or more combustion gas injection nozzles being separately provided in the bottom-less gas migration and isolation hollow plug, each of said combustion gas injection nozzles comprising a combustion gas nozzle pipe having, in a gas flow passage thereof, a nozzle directed toward the bottom-less gas migration and isolation hollow plug at one end thereof and a downward opening shutter adapted to close a gas passage in the combustion gas supply pipe connected to a combustion gas supply source at an other and thereof, a cylinder fastened to the uppermost point of said combustion gas nozzle pipe, said downward opening shutter movably connected via a movable connecting rod to a rod connected to the coke oven side of a piston reciprocating in said cylinder, and a gas flow pipe connecting the combustion gas pipe nozzle between said nozzle and downward opening shutter and the oven door side of said cylinder.

9. A coke oven door according to claim 1, further comprising one or more combustion gas nozzle pipes which are separately provided in the bottom-less gas migration and isolation hollow plug, each of said combustion gas injection nozzles comprising a combustion gas nozzle pipe having in the gas flow passage thereof a nozzle directed toward the bottom-less gas migration and isolation hollow plug at one end thereof and a downward opening shutter adapted to close a gas passage in the combustion gas supply pipe connected to a combustion gas supply source at the other, an ovally shaped annular member including an upper end which tilts toward a combustion gas supply source and lower end toward the nozzle, and a downward opening shutter closing an opening in said annular member from the side of the nozzle.

10. A coke oven door according to claim 8, further comprising a tar reservoir communicating with the combustion gas passage at one end and having a closing lid at an other end being disposed below one or more combustion gas supply pipes or combustion gas nozzle pipes separately provided in the bottom-less gas migration and isolation hollow plug.

* * * * *